US005325671A

United States Patent [19]

Boehling

[11] Patent Number: 5,325,671

[45] Date of Patent: Jul. 5, 1994

[54] ROTARY HEAT ENGINE

[76] Inventor: Daniel E. Boehling, 1801 Oakengate La., Midlothian, Va. 23113

[21] Appl. No.: 943,489

[22] Filed: Sep. 11, 1992

[51] Int. Cl.[5] ..... F02G 1/04

[52] U.S. Cl. ..... 60/682; 60/519; 60/650

[58] Field of Search ..... 60/519, 650, 682; 418/147

[56] References Cited

U.S. PATENT DOCUMENTS

| | | | |
|---|---|---|---|
| 3,833 | 11/1844 | Fletcher . | |
| 1,399,347 | 5/1920 | Jackson | 418/147 |
| 3,169,375 | 2/1965 | Velthuis . | |
| 3,698,184 | 10/1972 | Barrett | 60/650 |
| 3,774,397 | 11/1973 | Engdahl . | |
| 3,809,020 | 5/1974 | Takatani . | |
| 3,844,685 | 10/1974 | Eickmann . | |
| 3,978,680 | 9/1976 | Schukey | 60/519 |
| 4,089,174 | 5/1978 | Posnanski . | |
| 4,357,800 | 11/1982 | Hecker | 60/682 |
| 4,502,284 | 3/1985 | Chrisoghilos | 60/682 |
| 4,618,318 | 10/1986 | Hansen . | |

OTHER PUBLICATIONS

"Heat Power" by Norris and Therkelsen (US book, 1939), pp. 98–105.

"Heat Power Fundamentals" by Leonard and Maleev (US book, 1949), pp. 40–53.

*Primary Examiner*—Edward K. Look
*Assistant Examiner*—James A. Lasson
*Attorney, Agent, or Firm*—John F. C. Glenn

[57] ABSTRACT

Engine energized by an external heat source and cooled by an external cooling source, driven by a closed body of gas contained in chambers of variable volume and passages connected thereto, and operating on a Carnot cycle. The apparatus of the engine also has heat pump capabilities.

6 Claims, 13 Drawing Sheets

ROTARY HEAT ENGINE

BACKGROUND OF THE INVENTION

Environmental and fuel supply considerations have increasingly reordered priorities in designing engines which rely on burning fuel to produce power.

Internal combusion engines, driven by a reciprocating mechanism and operating on either Otto or Diesel cycles, have long been the popular choice for most applications. However, their combustion effluents and their reliance on petroleum fuels present increasingly difficult problems. Reviewed attention has therefore been directed to external combustion engines, which free combustion from the constraints of intermittent firing in a small space, and thereby open the way to improved combustion efficiency, wider choice of fuels, and better control of effluents.

For highest theoretical efficiency in external combusion engines, attention has long been given to Stirling cycle engines, which generate heat outside of a cylinder and conduct it through the cylinder wall to gas confined between two pistons in the cylinder. The heated gas powers the work stroke of one of the pistons to drive a crankshaft or the like. The other piston is driven by the shaft to aid in circulating the gas during the remainder of the cycle, including passing it through a heat absorbing regenerator and an external heat exchanger for cooling the gas. The Stirling cycle requires a closed body of gas which remains in gaseous state throughout, and operates in a sequence of heating the gas while at constant volume, followed by an adiabatic work stroke, cooling the gas while at constant volume, and adiabatic recompression of the gas before reheating.

The mechanical complications of Stirling cycle engine have led to development of other external combustion engines. Many of these avoid reciprocation by use of eccentric rotors in cylindrical stators and vanes extruding radially from the rotors to form a series of closed chambers between the vanes. The chambers expand in volume during half of each revolution of the rotor and contract during the other half revolution. The vanes can drive the rotor if gas at high pressure is supplied to the chambers as they begin to expand, as disclosed in U.S. Pat. No. 3,833 (Fletcher) issued in on Nov. 18, 1844. A closed body of gas for driving a vane type rotary engine is disclosed in U.S. Pat. No. 4,089,174 (Posnansky) issued May 16, 1978. Posnansky discloses use of solar power to heat the wall of a stator around a rotor carrying vanes forming closed chambers, where the chambers complete their contraction and begin expansion; and use of a radiator to cool gas withdrawn from the chambers while they are substantially fully expanded. After being cooled the gas is conducted back to the chambers while they are contracting. The Posnansky engine depends on the limited amount of heat that can be absorbed by a stator wall and transferred to a gas inside the stator next to the heated wall. Faster heating can be achieved by heating gas withdrawn from the stator and reintroducing it into such chambers as they begin to expand. This is disclosed in U.S. Pat. No. 3,774,397 (Engdahl) issued Nov. 27, 1973, but depends on the assistance of a pump and an operating cycle which involves condensation and vaporization of the gas.

SUMMARY OF THE INVENTION

In accordance with the present invention a body of gas is confined within chambers of varying volume between a rotor and a stator, and within passages which are closed except where they open into the chambers. The passages extend through the stator between the parts of the passages which open into the chambers and parts of the passage which extend outside of the stator. The rotor carries projecting vanes which separate the chambers and cause them to rotate with the rotor. The rotor is eccentrically journaled in the stator so that the chambers expand in volume during half of each revolution of the rotor and contract during the other half of each revolution. When there is higher pressure of the gas within the expanding chambers than within the contracting chambers there is a net pressure on the vanes to drive the rotor.

Pressure on the vanes for driving the rotor is generated by heating a group of the passages which open into the chambers where they are initially expanding. The portions of the heated passages which extend outside of the stator are continuously heated to high temperatures by any convenient means outside of the stator (such as flames against heater tubes containing the gas). This increases the temperature of the gas in each of the heated passages and hence increases its pressure, especially during the intervals when the passage is closed between its successive openings into the passing chamber. When a heated passage initially opens into a passing chamber it has greater gas pressure than the gas in the chamber and hence spurts an increment of higher temperature gas into the chamber. A return flow of increments of gas from the chambers move back into the passages while their connections are open.

Similarly, the other passages are continuously cooled to low temperatures by any convenient means outside of the stator, such as immersion in ambient air or water of tubes containing the gas. This reduces the pressure and temperature of gas in each of the cooled passages. When any of the cooled passages initially opens into a passing chamber, the gas pressure in the passage is less than the gas pressure in the chamber and hence an increment of higher temperature gas spurts from the chamber into the passage. A return flow of gas from the chambers moves back into the passages from the chambers while their connections are open. For stable operation at a constant rotor speed, the cooling of the gas is enough to return the temperature and pressure of the gas in each chamber at the end of each contraction to what it had been at the beginning of its expansion.

Such passages and chambers permit an efficient Carnot cycle type of operation to be achieved, particularly if the hot gas received by the expanding chambers is enough to cause the temperature in the chambers to remain substantially constant while they complete their expansion after receiving the hot gas, and if the cold gas received by the contracting chambers is enough to cause the temperatures in the chambers to remain substantially constant while they complete their contraction after receiving the cold gas. Continued expansion of each chamber after leaving the open ends of the heated passages is adiabatic, and continued contraction of each chamber after leaving the open ends of the cooled passages is adiabatic. The cycles repeat once operation stabilizes at a constant rotor speed.

To start the engine and to control variations of performance at different rotor speeds, auxiliary tanks to hold gas at various pressures may be provided, with connections and valves between the tanks and where heated and cooled gas is supplied to the engine. This enables pressures in the expanding chambers to be increased relative to pressures in the contracting chambers, for starting purposes, and changes in confined gas content and pressure for improving efficiency when changing one steady engine speed to another.

Other objects, advantages and details of the invention will become apparent as the following detailed description proceeds.

DESCRIPTION OF THE DRAWINGS

The accompanying drawings show, semi diagrammatic and for purposes of illustration only, present preferred embodiments of the invention, in which.

DETAILED DESCRIPTION OF PRESENT PREFERRED EMBODIMENTS OF THE INVENTION

Figure 1:
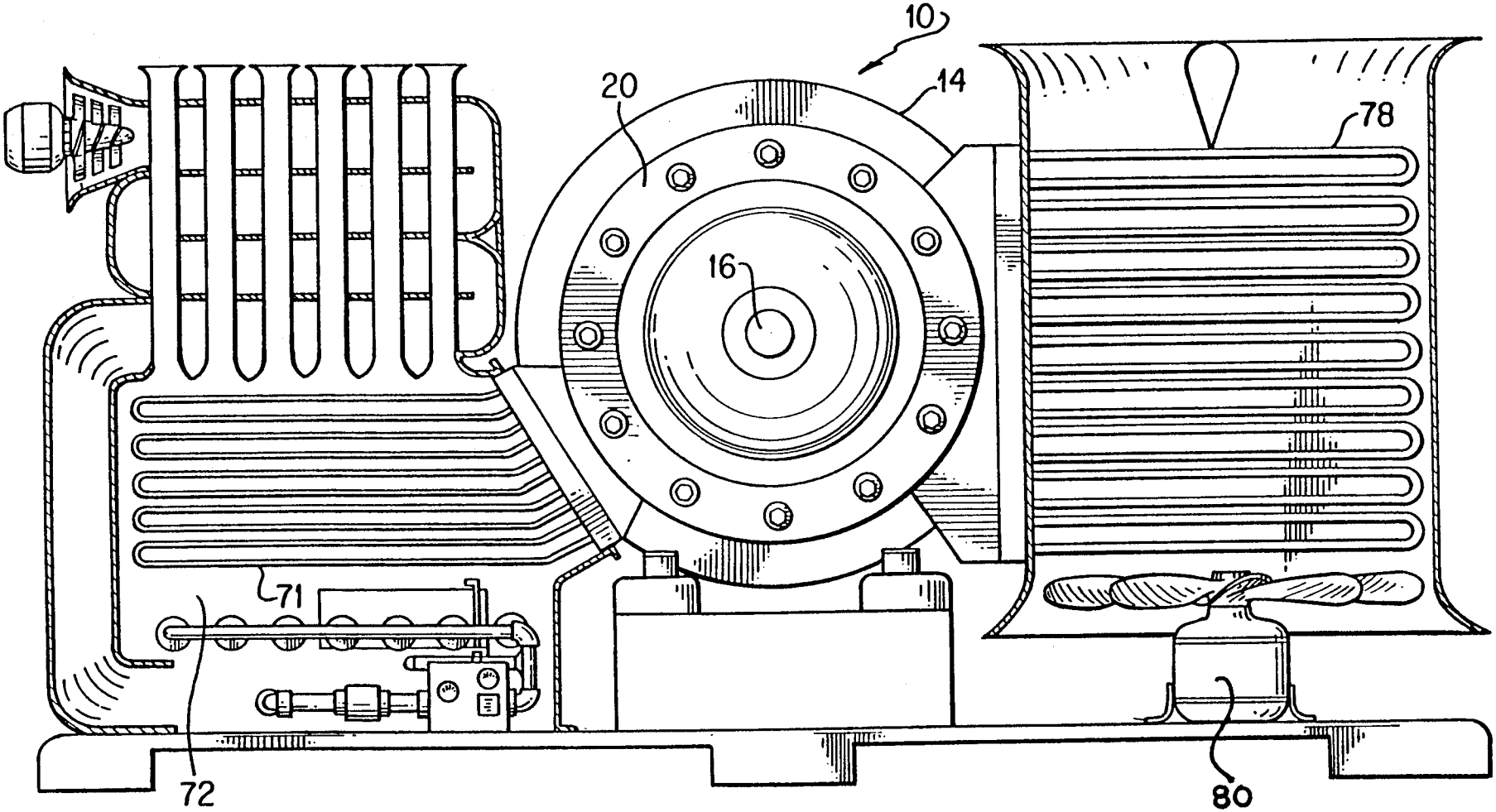
FIG. 1 shows an end view of an engine embodying the invention, including the associated heating and cooling means.
Figure 2:
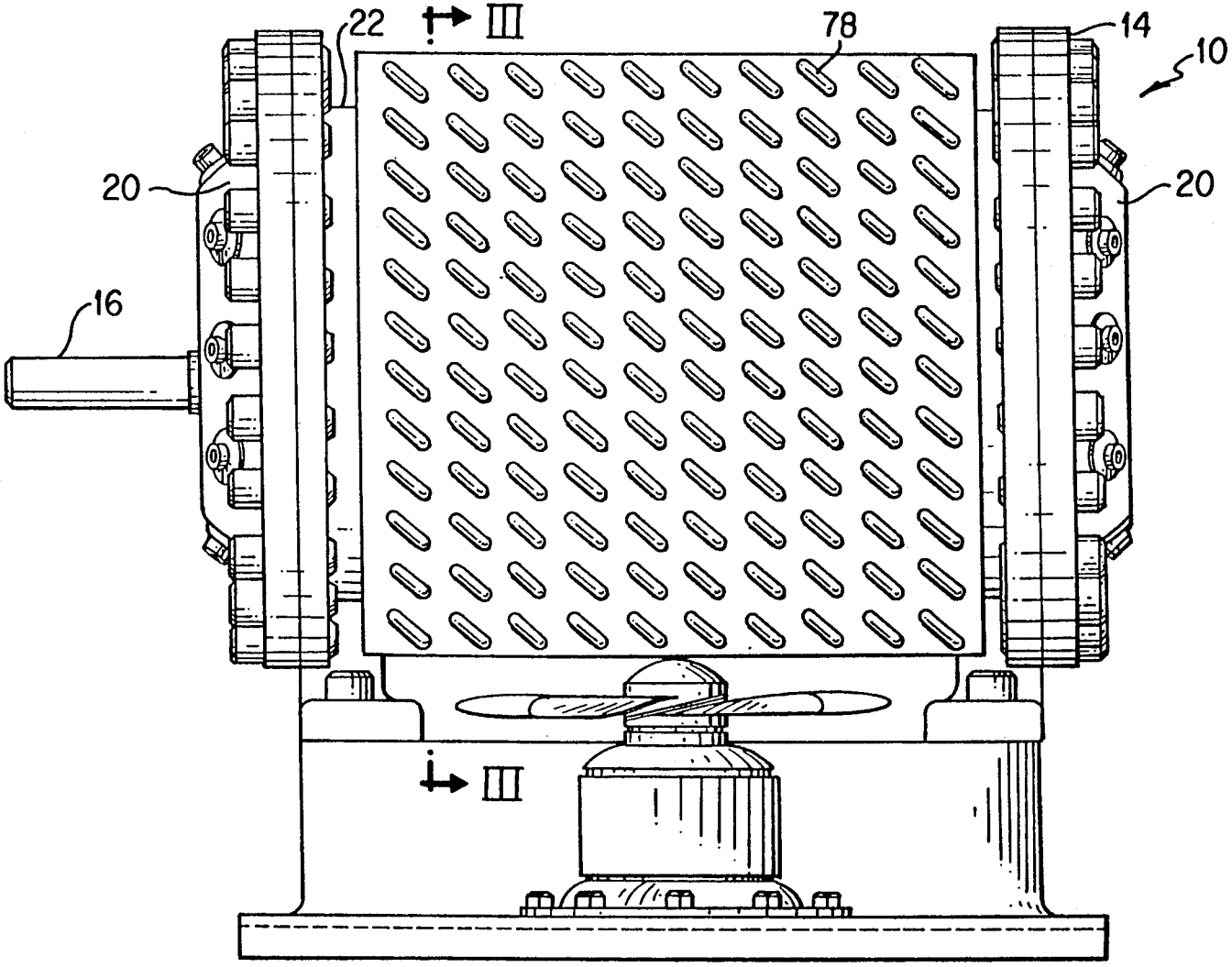
FIG. 2 shows a view from the right side of FIG. 1, in enlarged scale and omitting the walls around the cooling tubes.

Referring now more to particularly to the embodiments of the invention shown in the drawings, and initially referring to FIGS. 1, 2, 3A, 4A, 5 and 7, an engine 10 has a rotor 12 enclosed in a stator 14 and fixed to a supporting shaft 16 which is concentric with rotor 12 and rotatable in bearings 18 mounted on end caps 20 at opposite ends of the stator. The end caps 20 are sealed to the ends of a tubular metal shell 22 of the stator having a cylindrical interior surface 24. The central axis 26 of surface 24 is parallel to but offset from the axis of rotation of shaft 16 and rotor 12, so that the rotor is closer to one side of surface 24 than to the opposite side.

Rotor 12 has radially extending slots 28 which mount vanes 30 extending radially from rotor 12. The radially outer margin of each vane carries a shoe 32 having an arcuate face **32*a* fitting concentrically with and slidably against interior surface 24. The vanes and shoes separate a series of chambers 34 which are confined in the space which extends between the inner surface 24 of stator 14 and the outer cylindrical surface of rotor 12 and is enclosed at its ends by pairs of rings 50, 51, 53 and 55, as hereinafter described. The chambers 34 are separated from each other by the vanes 30 and shoes 32. The chambers are sealed against entry or escape of gas except through ports 66 and 68 through surface 24**, as hereinafter described.

Figure 3A:
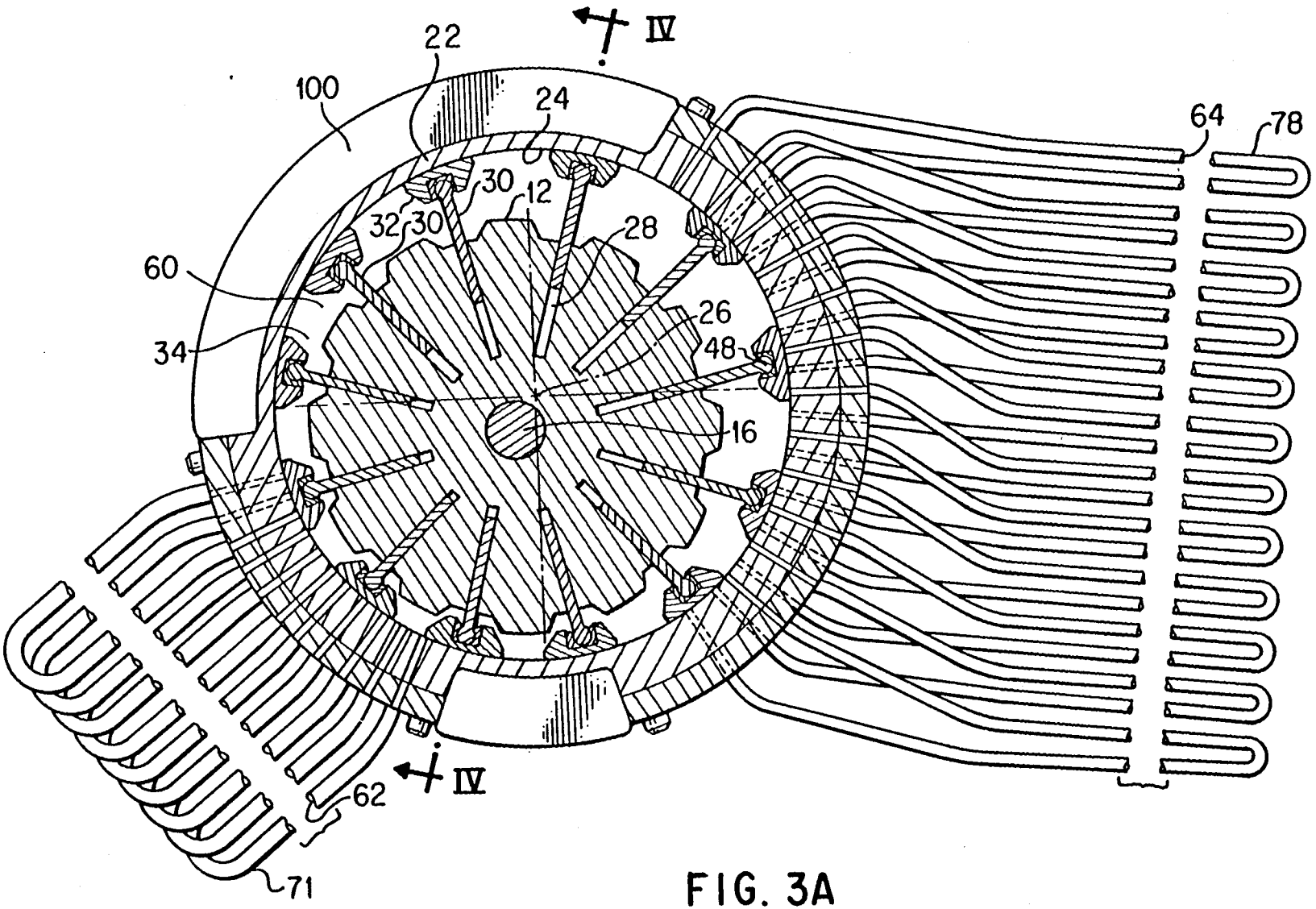
FIG. 3A shows a section on the line III—III shown in FIG. 2, in which both ends of each heating passage and each cooling passage are open and pass radially through the stator.
Figure 13:
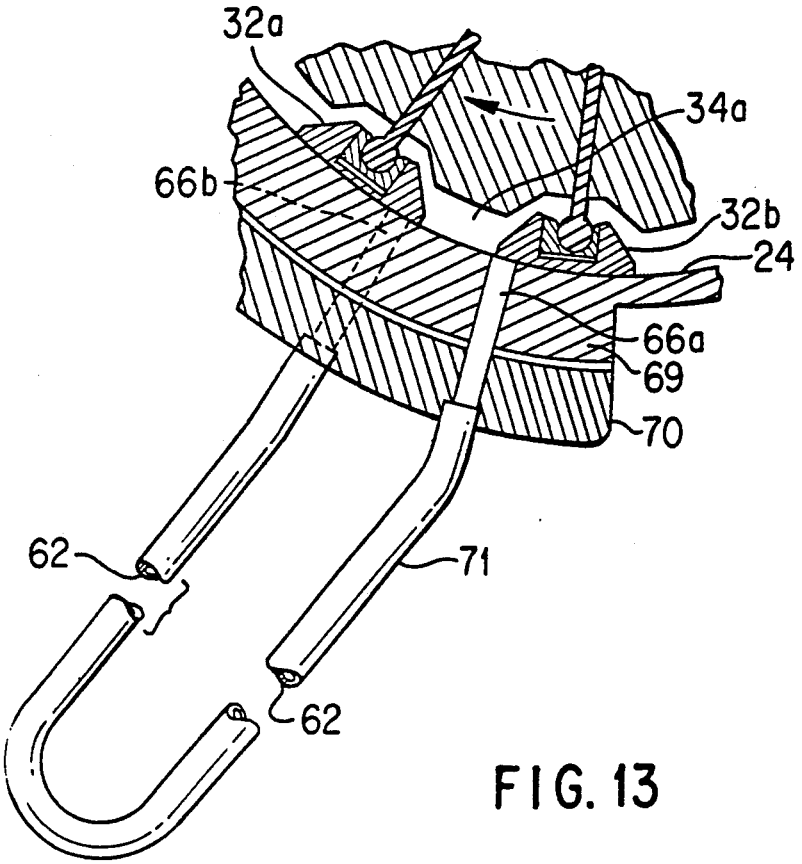
FIG. 13 shows an enlarged and broken away part of FIG. 3A where a heated gas passage enters the stator.
Figure 14:
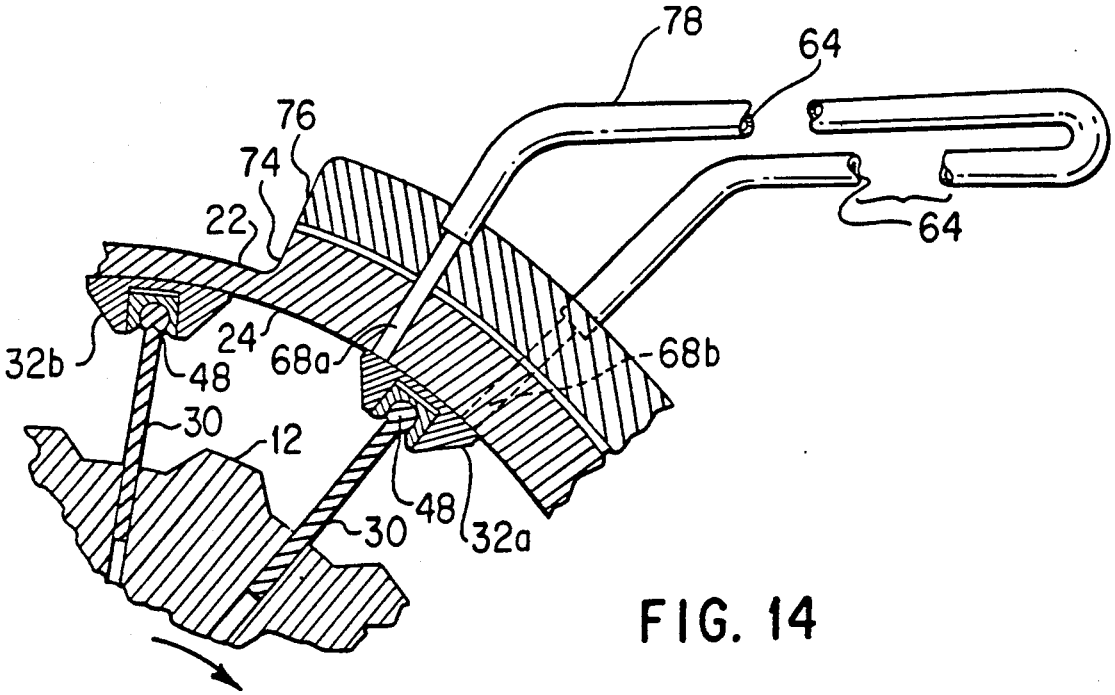
FIG. 14 corresponds to FIG. 13, but shows a cooled gas passage entering the stator.

Vanes 30 progressively extend radially outwardly and chambers 34 progressively expand in volume during a 180° turn of shaft 16 (clockwise as shown in FIGS. 3A, 13 and 14). The vanes and chambers progressively retract and contract during the remainder of a full 360° turn of the shaft. Such expansion and contraction occurs on opposite sides of a plane 36 through the central axes of interior surface 24 and shaft 16.

Figure 4A:
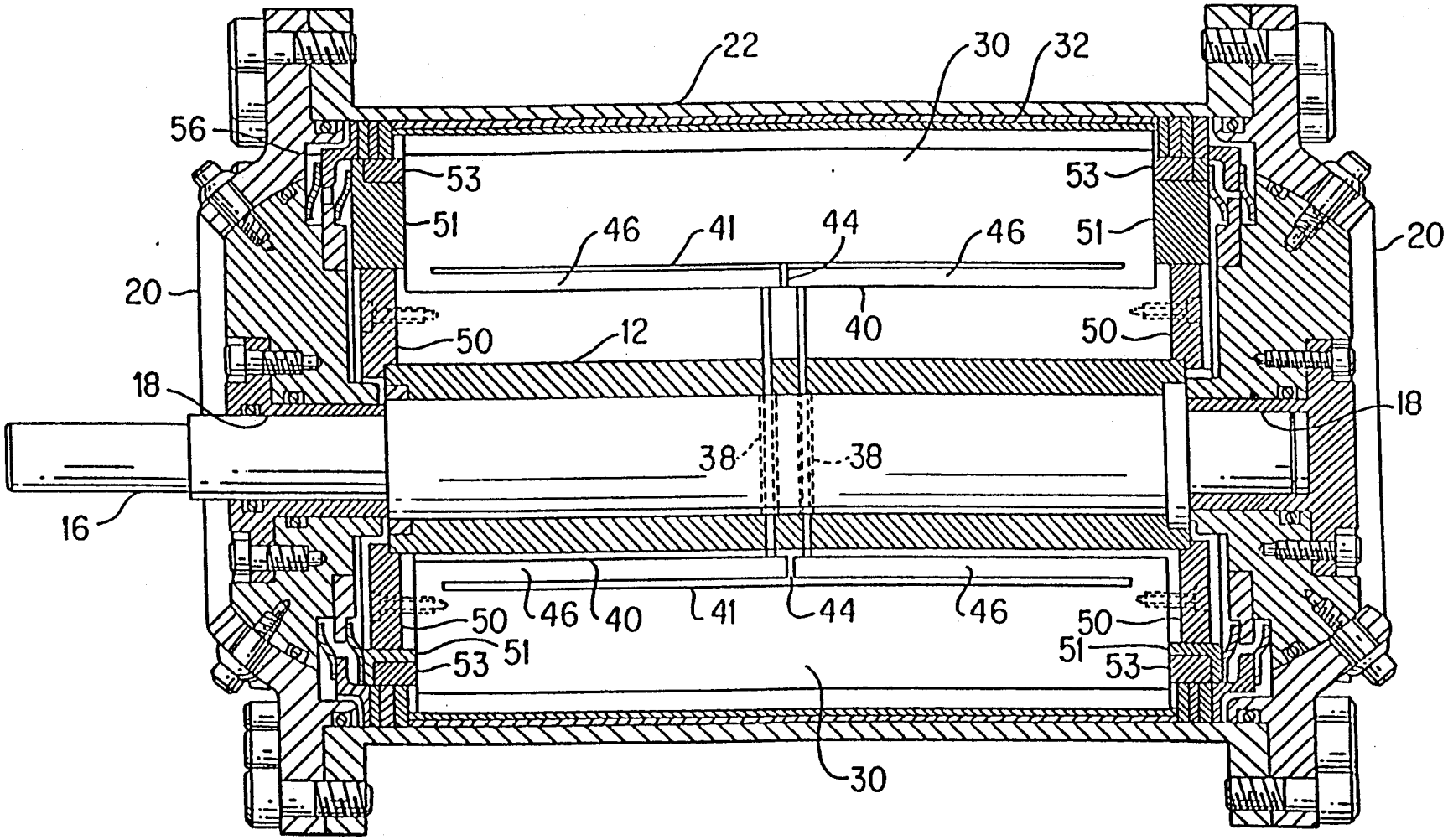
FIG. 4A shows a section on the line IV—IV in FIG. 3A, in enlarged scale.

The force to press the vanes outwardly to hold their shoes firmly against interior surface 24 is provided by having an even number of vanes and by mounting each vane to move radially in the same plane as a vane on the opposite side of the rotor. As shown in FIG. 4A, a pair of parallel rods 38 extend through the axis of shaft 16 to connect the inner margins 40 of a pair of opposite vanes 30 rigidly together. Rods 38 move freely through openings through shaft 16, slide through openings through rotor 12, and pass through the slots 28 which receive the margins 40. This causes the one of the connected vanes which is pushed in during chamber contraction to push the opposite vane out, and would seem to solve the problem of keeping the shoes of both of the opposite vanes against interior surface 24. However, geometric analysis shows that there is a slight variation of spacing between opposite shoes during each revolution of the rotor. Therefore, the rods 38 have a length which holds the vanes apart at the maximum spacing between the opposite shoes; and each vane 30 is made of steel flexing enough to permit the necessary small movement of opposite shoes toward each other during each rotor revolution, and to exert resilient outward pressure to urge the opposite shoes apart to their maximum spacing while permitting them to retract to their minimum spacing. For this purpose each of the vanes has a longitudinal slot 41 extending near and parallel to most of the length of its inner margin 40, and a radially extending slot 44 between slot 42 and the center of margin edge 40. The connections of rods 38 to margin 40 are on opposite sides of slot 44, so that each rod 38 presses against an arm 46 of vane 30 formed between slot 41 and margin 40 and between slot 44 and the unslotted portion of the vane at one end of slot 42. The flexing of the arms 46 of each vane provides the necessary resilient adjustment of spacing of opposite shoes 32. The rods 38 of each pair of opposite vanes 30 are spaced equally from slot 44, but the amount of spacing is different in the case of each different pair of the rods for the other vanes in order to provide clearance where the rods pass through shaft 16. An alternative solution of the clearance problem is to replace rods 38 with two solid metal rings pivotally connected to the inner margin 40 of each of the vanes 30, and to mount the rings in slots around the rotor which allow the ring to move with the vanes relative to shaft 16.

Figure 11:
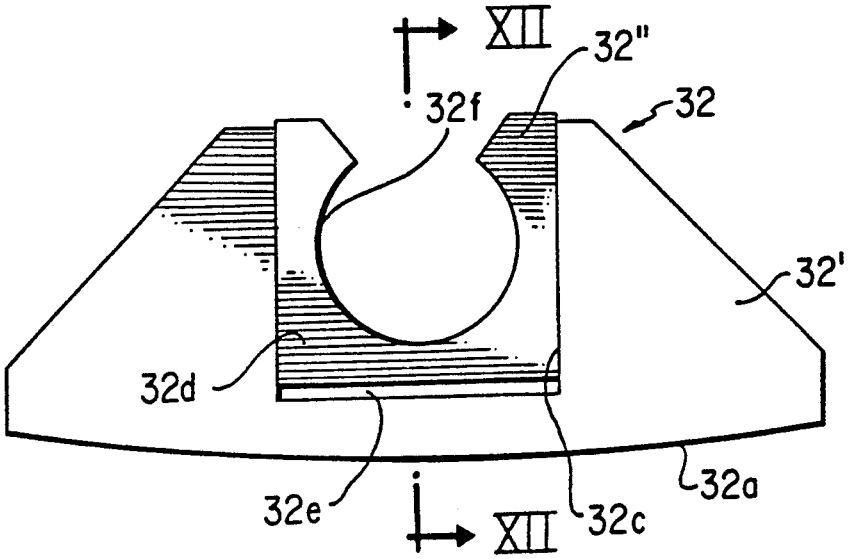
FIG. 11 shows an enlarged end view of one of the shoes shown in FIG. 4A against the inside of the stator.
Figure 12:
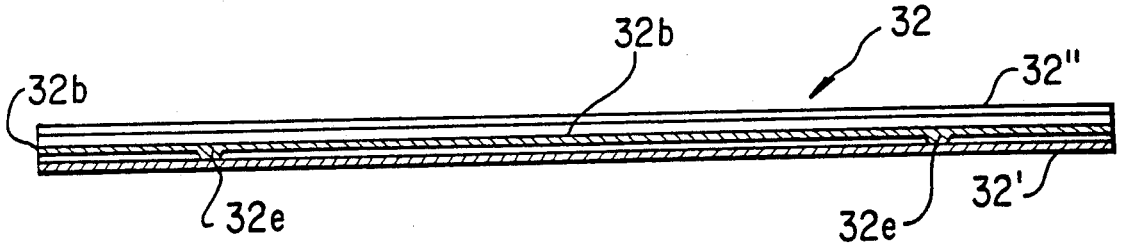
FIG. 12 shows a section on the line XII—XII in FIG. 11, in reduced scale.

Each of the shoes 32 has interfitting components 32' and 32'' of uniform cross-section along their lengths (with the exception of elements **32*e* where they come together, as noted below); see FIGS. 11 and 12. Their lengths extend almost to the opposite ends of stator surface 24. Components 32' extends outwardly to its arcuate face 32*d* against stator surface 24, and along its rear has an inwardly opening slot 32*c* along its length. Component 32'' is inward of component 32' and has an outer projection 32*g* that fits slidably into slot 32*c* to align components 32' and 32''. The end of projection 32*g* facing the bottom of slot 32*c* is relieved to provide a pair of raised elements 32*e* spaced about equally from each other and the ends of slot 32*c*. Pressure from a vane against a shoe is transmitted from component 32'' to component 32' through raised elements 32*e*, in order to provide a yoke that accommodates any tendency of the shoe to bend as it rotates against surface 24. A bulbous tip 48 (FIG. 14) of semicircular cross-section extends along the outer margin of each vane 30 between its radially extending sides, and each shoe component 32'' has a slot 32*f* (FIG. 11) of semi-circular cross section which fits slidably around the tip 48 of an adjacent vane to hinge the shoe and vane together. This enables their angular relation to adjust as the shoe rotates around stator surface 24**, while preventing escape of gas between the compartments through the hinged connection.

Figure 5:
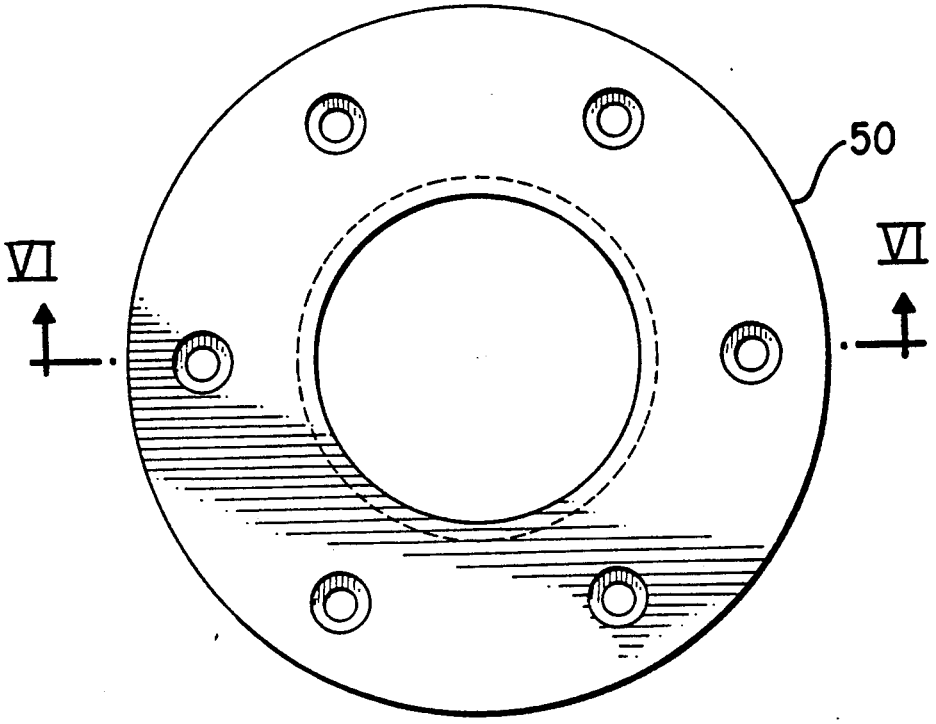
FIG. 5 shows an enlarged end view of one of the pairs of rings shown next to the rotor ends in FIG. 4A.
Figure 6:
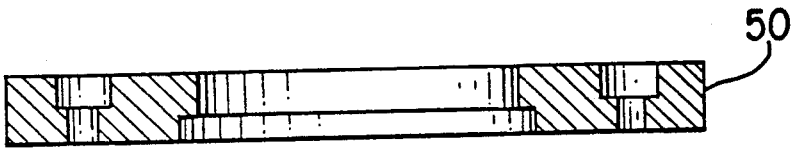
FIG. 6 shows a section on the line VI—VI in FIG. 5.
Figure 7:
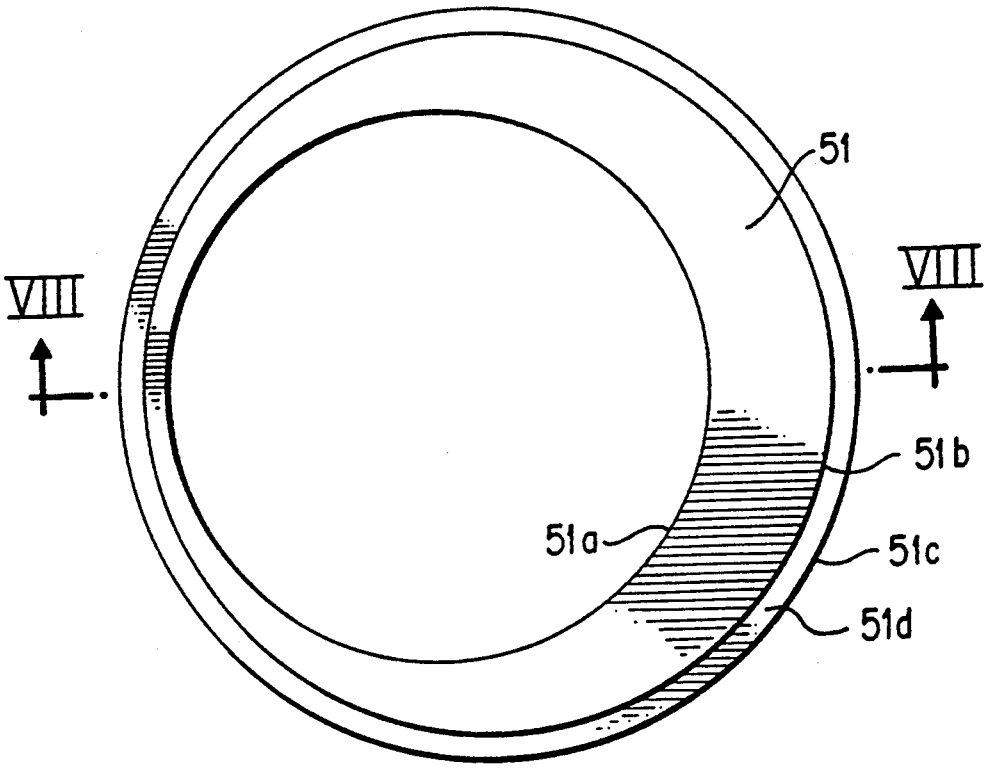
FIG. 7 shows an enlarged end view of one of the pair of eccentric rings shown next to the vanes in FIG. 4A, in reduced scale.

The ends of rotor slots 28 are closed by a a pair of rings 50 pinned to the opposite ends of rotor 12 (FIGS. 4A and -B). Rings 50 are concentric with and of the same outer diameter as the rotor (FIGS. 5 and 6).

Figure 8:
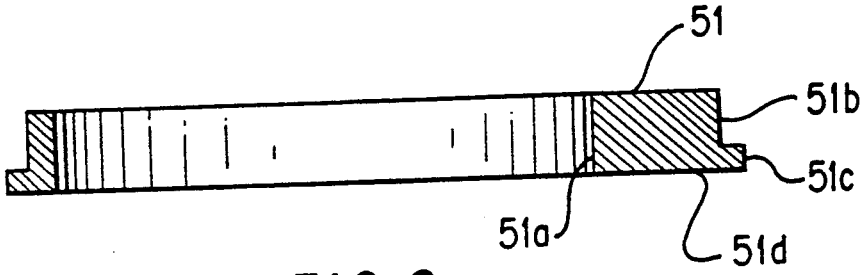
FIG. 8 shows a section on the line VIII—VIII in FIG. 7.

The following pairs of rings extend around the opposite ends of rotor 12 and adjacent rings 50 and between them and rotor surface 24, in order to prevent escape of gas from compartments 34 around the opposite sides of vanes 30 between rotor 12 and shoes 32:

First and innermost are a pair of rings 51 (FIGS. 7 and 8) which have their inner peripheries **51*a* slidable around the ends of rotor 12 and adjacent rings 50, and their outer peripheries 51*b* and 51*c* concentric with stator surface 14 and hence eccentric relative to inner peripheries 51*a*. This prevents rings 51 from rotating with rotor 12. Each outer periphery 51*b* is next to a flange 51*d* extending outwardly around one of the rings 51. Each outer periphery 51*c* is the outer periphery of one of the flanges 51*d***.

Figure 10:
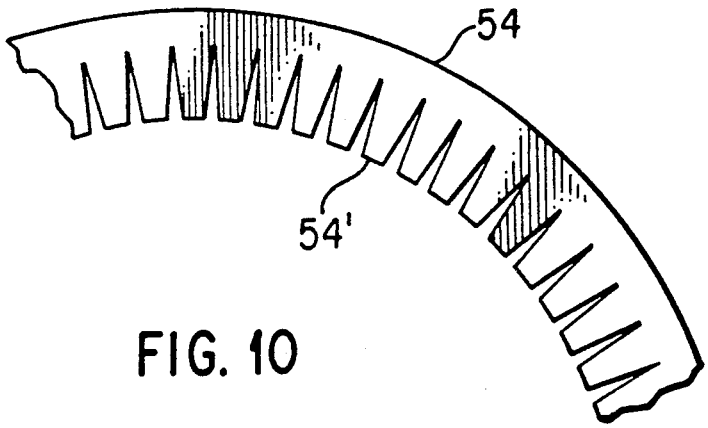
FIG. 10 shows a broken away and enlarged end view of one of the pair of rings which press against the pair of eccentric rings shown in FIG. 4A.

Next are a pair of rings 53 which have concentric peripheries. Their inner peripheries extend slidably around the outer peripheries **51*b* of rings 51, and their outer peripheries are flush with the outer peripheries 51*c* of ring flanges 51*d*. The rings 53 each have one side next to one of the flanges 51*d*. The other side of each ring 53 is flush with the corresponding side of the adjacent ring 51. Each pair of adjacent rings 51 and 53 are pressed together toward the projecting sides of vanes 30 by a pair of rings 54 (FIG. 10) having inwardly extending resilient fingers 54' pressing against stator end caps 20**.

Figure 4B:
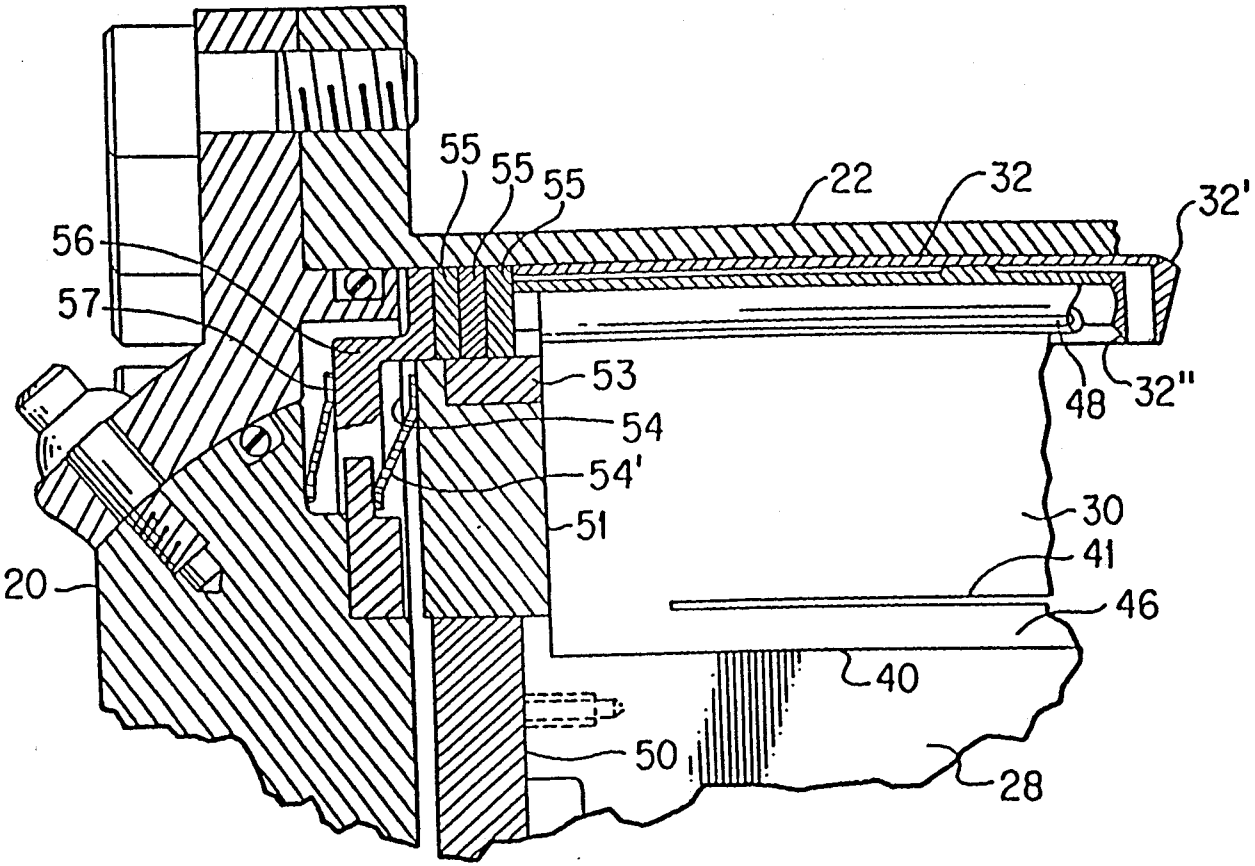
FIG. 4B shows an enlarged and broken away portion of FIG. 4A.
Figure 9:
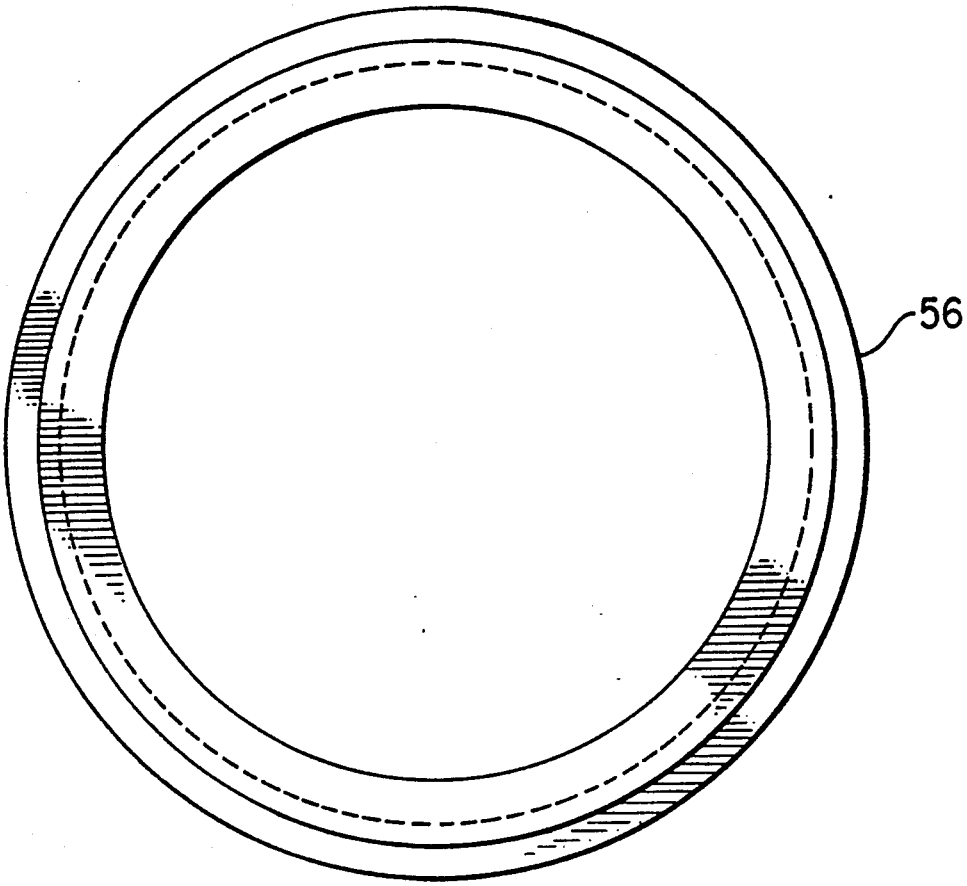
FIG. 9 shows an enlarged end view of one of the rings of Z-cross section shown in FIG. 4A.

Last are two sets of triple rings 55 (FIG. 4B), which are mounted side-by-side around adjacent rings 51 and 53 and between them and stator surface 24. Each ring 55 is cut across at one place like a piston ring. The middle ring 55 of each set is resiliently biased inward to bear slidably against one of the rings 51, and the two outer rings 55 of each set are resiliently biased outwardly to bear slidably against stator surface 24. The two sets of rings 55 are pressed against surfaces **32*h* (FIG. 12) at the opposite ends of shoes 32 by a pair of rings 56 of Z-cross section (FIG. 9), which in turn are pressed by a pair of rings 57 having inwardly extending resilient fingers bearing against stator end caps 20**.

The opposite ends of shoes 32 project beyond the sides of vanes 30 to fill the annular spaces not occupied by rings 55 between rings 53 and stator surface 24, and thereby prevent escape of gas through that space between adjacent chambers 34.

A body of gas 60 is confined within chambers 34 and passages 62 and 64. Passages 62 are connected to the chambers through ports **66*a*** and -*b*, and passages 64 are connected to the chambers through ports **68*a*** and -*b*. The said chambers and passages have no other inlets or outlets except through said ports (or through connections to lines 90 and 94 as hereinafter described, which are open only in exceptional circumstances.

The gas 60 may be one gas or a mixture of gases, which are preferably inert and relatively dense for heat absorption and conduction. Argon is preferred.

Each passage 62 connects at its opposite ends with a pair of ports **66*a*** and -*b*, and extends from each of these ports through a thickened outward projection 69 of stator shell 22, through a header 70 attached to projection 69, and thence through a U-shaped tube 71 having its opposite ends mounted on the header. Each U-tube 71 is exposed to flames or other radiant or conducted heat from a fire box 72 or the like, where heat is continuously generated outside of the stator 14 and chambers 34 for purposes of raising the temperature of the gas in the passages 62 to high temperatures, such as 1400° F. in U tubes 71 and 1200° F. near ports **66*a*** and -*b*.

Each pair of ports **66*a*** and -*b* are spaced from each other along the circumference of stator surface 24, so that the leading edge of each shoe 32 passes over one of each pair of connected ports **66*a*** and -*b* before it reaches the other. Each shoe 32 simultaneously covers both connected ports **66*a*** and -*b* as it moves over them, never uncovers both connected ports **66*a*** and -*b* while the shoe moves between them during chamber expansion, and never connects adjacent chambers 34 through a passage 62. Each pair of connected ports **66*a*** and -*b* are also offset from each other toward opposite ends of surface 24. This facilitates positioning the two halves of each passage 62 connected to the respective ports **66*a*** and -*b* in different planes, to help keep them apart where they approach the connected pair of ports.

The shoes 32 pass over a given pair of ports **66*a*** and -*b* where the chambers 34 are beginning to expand again during each revolution of shaft 16. Taking as an example the clockwise movement shown in FIG. 13 of a leading shoe **32*a* and following shoe 32*b* relative to a pair of the ports 66*a*** and -*b* (numbered in clockwise sequence) connected by a passage 62 and U-tube 71, and the corresponding movement of a leading chamber **34*a*** between these shoes, the following occurs:

(1) When shoe **32*a* covers both ports 66*a*** and -*b*, both outlets of the passage 62 are closed, the part of the passage 62 formed by the U-tube 71 is heated in fire box 72, and the resultant heating of gas 60 in the U-tube raises temperature and pressure of gas in passage 62 as long as the passage remains closed.

(2) When the trailing end of shoe 32*a* initially uncovers port 66*a* to open into chamber 34*a*, the other port 66*b* remains covered, so that passage 62 is then open only at port 66*a*. The step (1) heating has increased the temperature and pressure of gas in the passage over that in chamber 34*a* and hence a spurt of hot gas from the passage through port 66*a* enters chamber 34*a* to increase its average temperature and pressure, and an exchange flow of lower temperature gas from the chamber enters the passage.

(3) As shoe 32*a* moves in a little further it continues to cover port 66*b* and the following shoe 32*b* covers port 66*a* (as shown in FIG. 13). This permits a brief build up of temperature and pressure in passage 62.

(4) As the shoes move on a little further shoe 32*a* uncovers port 66*b* shortly after port 66*a* is closed by shoe 32*b*. Heating of U-tube 71 meanwhile has raised the temperature and pressure of gas in passage 62, as a spurt of hot gas from port 60*b* enters the chamber 34*a* and an exchange flow of lower temperature gas from the chamber 34*a* enters the passage 62.

(5) As the shoes 32*a* move on the following, shoe 32*b* covers both ports 66*a* and -*b*, which ends the cycle of the passage of chamber 34*a* over ports 66*a* and -*b*.

As rotor 12 turns the shoes 32 successively cover and uncover the connected pairs of ports 66*a* and -*b* to add increments of heat to the gas in the chambers 34. The increments of added heat from many pairs of these ports heat the gas 60 to increase its pressure and thereby drive the vanes 30 and shaft 16. The ports 66*a* and -*b* are preferably located where they will open to each chamber early in its period of expansion, such as within about one third of the surface 24 from the place where rotor 12 comes closest to that surface. Thereafter each chamber completes its expansion without added heat. During expansion each chamber rotates 180° with rotor 12.

Figure 15:
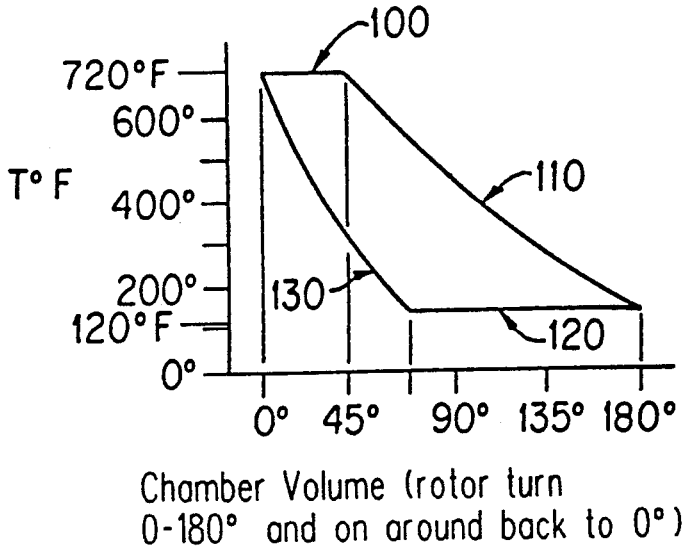
FIG. 15 shows a temperature-volume diagram conceived for the engines illustrated in FIGS. 1-14.
Figure 16:
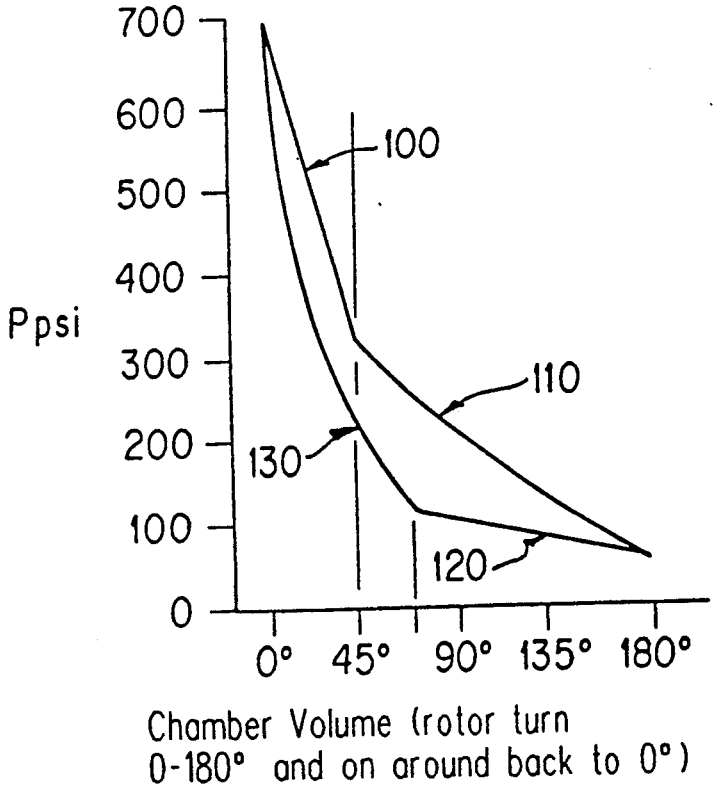
FIG. 16 corresponds to FIG. 15 but shows a pressure-volume diagram for the engines.

Operation of engine 10 is based on a Carnot cycle for each chamber 34. The steps of each cycle are as follows: substantially isothermal heating of gas 60 in each chamber as the chamber expands while it passes over ports 66*a* and -*b* (step 100 in FIGS. 15 and 16); substantially adiabatic expansion of the heated gas in the chamber until the chamber completes its expansion (step 110 in FIGS. 15 and 16); substantially isothermal cooling of the gas as the chamber passes over port 68*a* and -*b* while the chamber begins its contraction (step 120 in FIGS. 15 and 16); and substantially adiabatic contraction of the gas as the chamber completes its contraction (step 130 in FIGS. 15 and 16). The passages 64 extend through an outward projection 74 from shell 22, a header 76, and U-tubes 78 mounted on the header. The U-tubes 78 are exposed to a coolant, such as by exposure to ambient air from a fan 80 or by immersion in water from a convenient source, such as a stream or large body of cold water. All of the ports 68*a* and -*b* are located within an arc of about a third of the circumference of stator surface 24 extending from about where each chamber is at maximum expansion to about where it is after turning about 120° from its position of maximum expansion while contracting toward its position of maximum contraction.

Again taking the example of a leading shoe 32*a* and following shoe 32*b* with a chamber 34*a* between them, and considering a pair of ports 68*a* and -*b* respectively nearest to and farthest from oncoming shoes as rotor 12 rotates clockwise and a passage 64 connecting ports 68*a* and -*b* through U-tube 78 (as shown in FIG. 14), the following sequence occurs:

(a) When shoe 32*a* covers both ports 68*a* and -*b*, both outlets of passage 64 are closed, gas 60 is cooled in U-tube 78 and the temperature of gas 60 in passage 64 is reduced as long as the passage remains closed at both ends.

(b) When the trailing end of shoe 32*a* initially uncovers port 68*a* to open into chamber 34*a*, the other port 68*b* remains covered, so that passage 64 is then open only at port 68*a*. The step (a) cooling has reduced the temperature and pressure of gas in the passage 64 below that in chamber 34*a* and hence relatively hot gas in the chamber pushes through port 68*a* into the passage to increase its average temperature and pressure while incrementally reducing the pressure and temperature in chamber 34*a*.

(c) As shoe 32*a* moves on a little further it uncovers port 68*b* while port 68*a* remains open. While both ports are open passage 64 tends to equalize pressure at both ends and to expel mixed cooler gas into chamber 34*a*. Such simultaneous opening of both ports occurs in the cooling zone, where the vanes 30 are close to their maximum projection and hence space the shoes further apart than in the heating zone, where vane projection and shoe spacing are close to minimum.

(d) As shoe 32*a* moves on the following shoe 32*b* covers port 68*a* into passage 64 before shoe 32*b* also covers port 68*b*. Step (a) then repeats for the next chamber and shoe 32*b* in place of shoe 32*a*.

The passages 64 thus incrementally cool the gas 60 in the successive chambers 34 as they pass over ports 68 and contract while doing so. The chambers complete their contraction after passing over ports 68, and begin expansion again when reheating resumes. Much more energy is supplied to drive shaft 16 during expansion of the chambers than is drawn from the shaft to contract them, so an efficient Carnot cycle can be achieved, especially when the gas from ports 66 is at high temperatures, such as 1200°F. During the heating part of the cycle the above step (1) is substantially isothermal and the above steps (2) through (3) are substantially adiabatic. During the cooling part of the cycle the above step (a) is substantially isothermal, and the above steps (c) through (d) are substantially adiabatic.

Figure 3B:
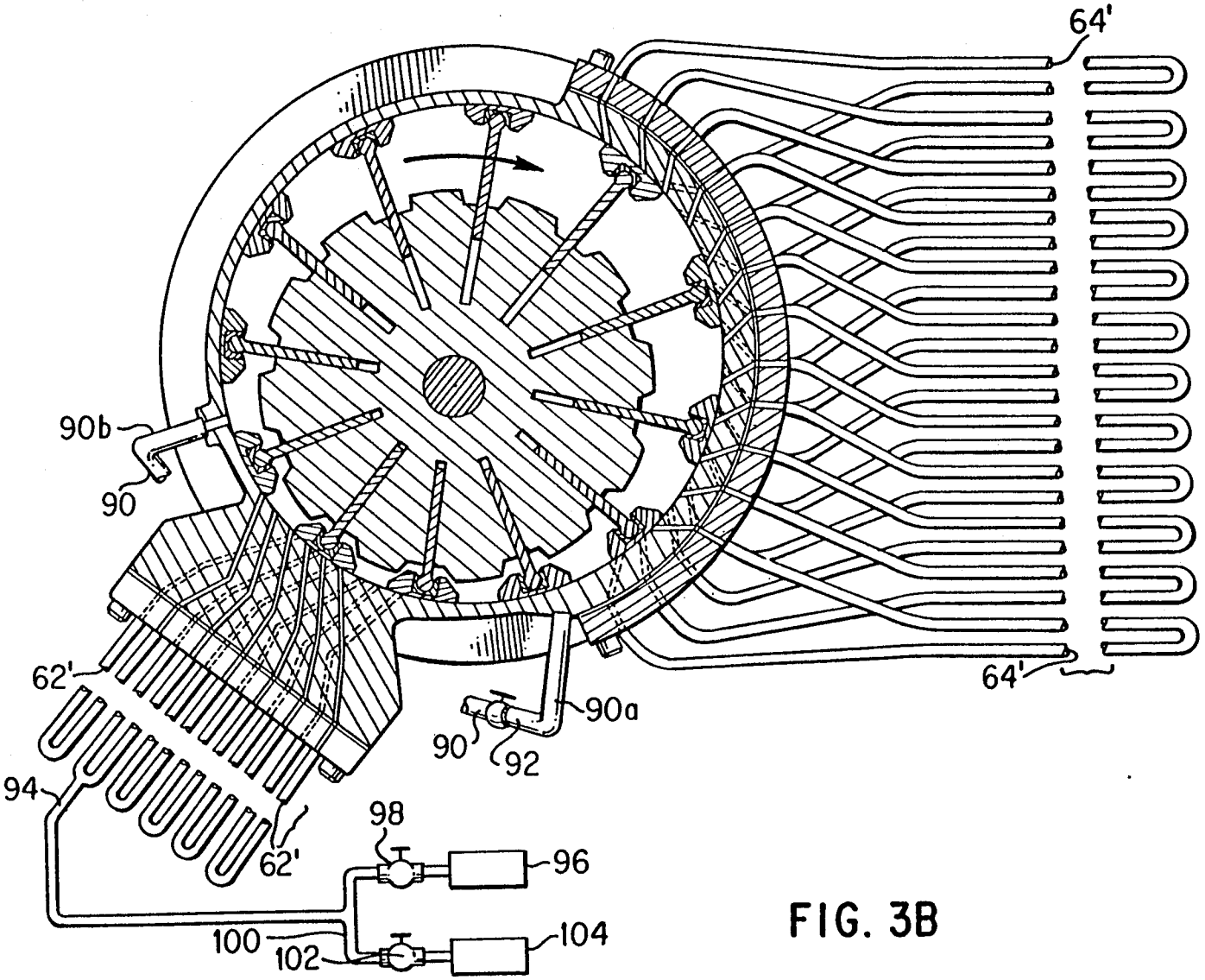
FIG. 3B shows a section corresponding to FIG. 3A except that the heating and cooling passages pass at different angles through the stator.
Figure 3C:
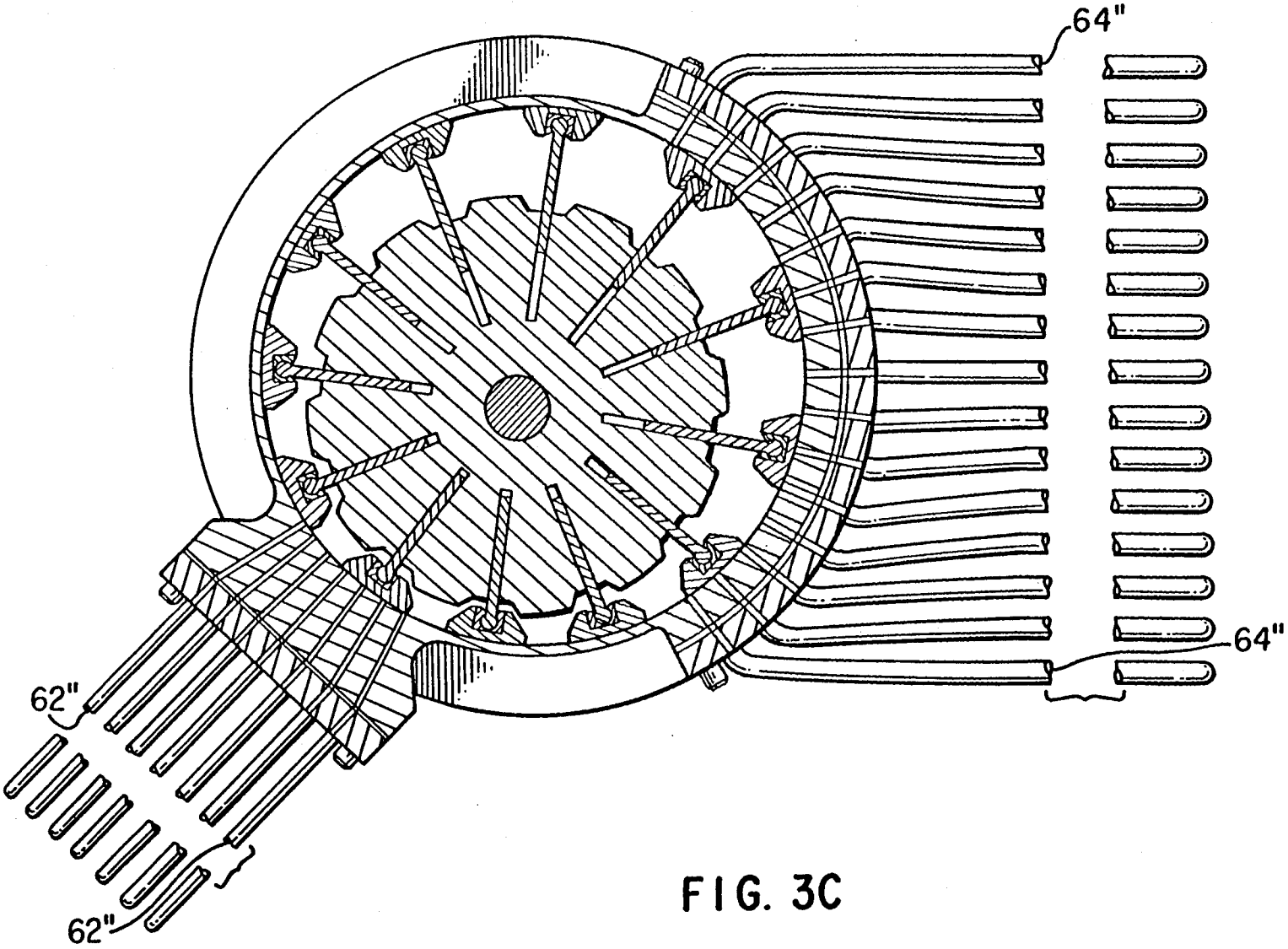
FIG. 3C shows a section corresponding generally to FIGS. 3A and -B but showing heating and cooling tubes which are each open only at one end.

The passages 62 and 64 may take forms other than those shown in FIG. 3A. As shown in FIG. 3B, each pair of connected hot passages 62' and each pair of connected cold passages 64' approach their ports at oppositely facing angles, for circulation of gas in chambers 34 passing over their ports. However, this is unlikely to be helpful at speeds in the usual ranges of one to several thousand RPM. As shown in FIG. 3C, each of the heated passages 62" and cooled passages 64" is closed at its outer end and opens at its inner end through a single port. Such passages would heat or cool substantially isothermally while closed by a shoe, and while open between shoes would function with a chamber substantially adiabatically. However, such closed end passages are not preferred.

When starting engine 10 after long inactivity, the gas pressures within the system may have become considerably equalized, and there may be considerable resistance to contraction of the chambers 34 passing the cool zone. Accordingly, as shown semi-schematically in FIG. 3B, it is desirable to provide a gas conductor line 90 extending at one end 90*a* through the stator shell 22 to open into the chamber 34 from their full expansion to their full contraction, and at the where they have turned about three quarters of their 180° turn other end 90*b* through the stator shell to open into the chambers where they have turned about a quarter of their 180° turn from their full contraction to their full expansion. A valve 92 in line 90 is a check valve which closes after start up, but opens during start up to reduce back pressure from the contracting chambers, and to add pressure to the expanding chambers. Also, a gas conductor line 94 is connected to one of the heated passages 62 to inject gas under pressure from a pressure tank or other source 96, for exerting pressure on vanes 30 where the chambers are expanding to cause rotor 12 to turn until the engine cycle provides the motive power. A valve 98 in line 94, between its connection with a passage 62 and tank 96, is closed except during start up.

Operating efficiency of an engine 10 is best at a steady operating speed and other conditions for which the engine is designed. For other speeds or under other conditions efficiency may decline, but that can be controlled by varying the amount of gas 60 confined in the system and thereby changing the operating pressures to best suit the altered speed or conditions. Accordingly, as shown in FIG. 3B, a branch 99 from line 94 is controlled by a valve 102 to bleed gas to a low pressure tank 104 when gas 60 in engine 10 is to be reduced, and valve 98 is opened when gas is to be injected into the engine.

Engine 10 preferably uses high density graphite (such as "Morganite" type CNFJ graphite from National Electric Carbon Company) for shoes 32 (both parts), rotor 12 and rings 50, 51, 53, and 56. Shell 22 (including its inner surface 24) and vanes 30 are preferably of stainless steel. The other parts are preferably made of less expensive steel except those requiring other materials, such as insulation 100 and O-rings. High density graphite wears well against itself and steel, and its use in engine 10 avoids use of lubricants and their problems of maintenance and breakdown at high temperatures. It is also lighter than steel, which holds down engine weight. The engine of the invention is suitable, for example, for producing an engine having a chamber of about 12.94" in length and 8.43 inch diameters, a compression ratio of about 6.3 to 1, a displacement of about 108 cubic inches, an output of about 20 horsepower at 1800 RPM, and a weight of about 100 pounds (including the heating and cooling pipes).

By driving shaft 16, in one direction or the other, the engine 10 may be used as a heat pump to transfer heat from U-tubes 71 to U-tubes 78 or vice versa.

While present preferred embodiments and practices of the invention have been illustrated and described, it will be understood that the invention may be otherwise variously embodied and practiced within the scope of the following claims.

I claim:

1. An engine comprising a stator having a circular interior surface, a rotor surrounded by said stator surface, means mounting the rotor for rotation about an axis parallel to but spaced from the central axis of said stator surface, a series of vanes carried by the rotor, means urging the vanes radially outward from the rotor, a corresponding number of shoes having arcuate surfaces slidable against and curved to conform to said stator surface, said arcuate surfaces having the same fixed arcuate length, means mounting each shoe on one of said vanes for pivotal movement about a pivotal axis adjacent to the radially outer end of the vane, said vanes and shoes separating a series of chambers between the rotor and said stator surface, said chambers being caused to expand in constant progression and said shoes to move apart in constant progression as the shoes move around one half of said stator surface from where the stator surface is closest to the rotor to where the stator surface is furthest from the rotor, and said chambers being caused to contract in progression and said shoes to move toward each other in constant progression as said shoes continue movement around the other half of said stator surface, means forming ports through said stator surface, each port being open into only one chamber at a time as the chambers rotate past each port, and said ports comprising a first set of ports which open into the chambers during their expansion and a second set of ports which open into the chambers during their contraction, means forming a first set of passages extending from said first set of ports through and outside of the stator, means forming a second set of passages extending from said second set of ports through and outside of the stator, means to heat a portion of said means forming said first set of a passages, means to cool a portion of said means forming said second set of passages, said heating means and cooling means being located outside of the chambers and the portion of the stator which encloses them, and means for sealing said chambers and passages to confine gas in the space within them and prevent outflow of gas from said space during operation of the engine.

2. An engine according to claim 1, in which said arcuate surface of each shoe extends substantially equally on both sides of the vane supporting the shoe.

3. An engine according to claim 1, in which said first and second sets of ports include pairs of said ports connected to different ones of said first and second set of passages, the two ports of each pair being connected to opposite ends of one of said passages and being spaced apart as viewed endwise of said stator surface less than said fixed arcuate length of each of said arcuate shoe surfaces, whereby said two ports cannot be uncovered at the same time on opposite sides of a shoe and thereby open into adjacent chambers at the same time.

4. An engine according to claim 3, in which said two ports of each pair of the first set of ports are spaced apart as viewed endwise of the stator surface more than the spacing between the shoes passing over them, whereby only one port at a time of said first set of ports can open into any one of the chambers passing over them.

5. An engine according to claim 1, in which each shoe has a component having a slot extending parallel to the axis of rotation of the rotor, and each vane has a radially projecting end which is bulbous in cross-section and extends into and pivots in said slot of said component of the shoe mounted on the vane.

6. An engine according to claim 1, in which the radially outer end of each vane extends parallel to the rotor axis and is of bulbous cross-section, in which each shoe has an elongated slot in a portion of the shoe which is integral with the arcuately curved surface of the shoe, in which said slot is elongated parallel to the rotor axis, and in which said shoe comprises a component which is slidable in said elongated slot toward and from the adjacent portion of said stator surface and which extends partially around said bulbous outer end of the vane carrying the shoe, thereby permitting pivotal and radial movement of the shoe relative to the vane supporting it to keep the shoe against said stator surface as the rotor turns and said heating and cooling means cause temperature differences around the stator adjacent to its said surface.

* * * * *